US005704690A

United States Patent [19]

Schwartz

[11] Patent Number: 5,704,690

[45] Date of Patent: Jan. 6, 1998

[54] YARN HAVING WICKER APPEARANCE AND ARTICLES MADE THEREFROM

[75] Inventor: Larry Schwartz, Franklin Lakes, N.J.

[73] Assignee: Sun Isle Casual Furniture, LLC, Franklin Lakes, N.J.

[21] Appl. No.: 697,464

[22] Filed: Aug. 26, 1996

[51] Int. Cl.[6] ..... A47C 5/02; A47C 5/12

[52] U.S. Cl. ..... 297/451.9; 297/452.64; 428/17

[58] Field of Search ..... 297/451.9, 452.63, 297/452.64; 428/15, 17

[56] References Cited

U.S. PATENT DOCUMENTS

| | | |
|---|---|---|
| D. 15,252 | 8/1884 | Williams . |
| D. 32,542 | 4/1900 | Tyler . |
| D. 91,125 | 11/1933 | Thomas . |
| D. 217,601 | 5/1970 | Borichevsky . |
| D. 220,906 | 6/1971 | Borichevsky . |
| D. 272,020 | 1/1984 | Baty . |
| D. 316,338 | 4/1991 | Frinier . |
| D. 328,981 | 9/1992 | Wisner . |
| D. 337,094 | 7/1993 | Bernstein . |
| D. 345,262 | 3/1994 | Caldwell . |
| 3,436,870 | 4/1969 | Sellman . |
| 3,691,749 | 9/1972 | McKay . |
| 3,700,544 | 10/1972 | Matsui . |
| 3,839,526 | 10/1974 | Riley et al. . |
| 4,460,649 | 7/1984 | Park et al. . |

OTHER PUBLICATIONS

Advertising copy from Brown Jordan "Eastlake" design.
Sample of synthetic yarn for "Eastlake" design.

*Primary Examiner*—Peter R. Brown
*Attorney, Agent, or Firm*—Lerner, David, Littenberg, Krumholz & Mentlik

[57] ABSTRACT

A polymer wicker-like yarn used in the fabrication of furniture and other items has a groove on the outer surface extending in an axial direction along the yarn. The groove may be interrupted or may wobble along the axis of the yarn. The yarn may also have a stripe extending along its axis, which may wobble and/or intersect the groove at various points along the stripe. A woven material having a wicker look incorporates the wicker-like yarn as the weft yarn and may incorporate the wicker-like yarn as the warp yarn. An article of furniture having a wicker look incorporates panels of the material.

26 Claims, 7 Drawing Sheets

YARN HAVING WICKER APPEARANCE AND ARTICLES MADE THEREFROM

BACKGROUND OF THE INVENTION

The present invention relates in general to synthetic yarns, and weaves and articles made therefrom. More specifically, the present invention relates to synthetic yarns of polymer material having a natural wicker appearance and articles of furniture made from weaves thereof which are suitable for use in a variety of environments such as outdoors. The yarns and weaves of the present invention are disclosed in Applicant's pending Design Application Ser. No. 29/056,425, filed on Jun. 28, 1996.

Natural wicker has been used in the manufacture of furniture, baskets and other articles for many centuries. Natural wicker articles are manufactured from the twigs or branches of various plants that are first soaked in water in order to make them pliable, then woven to form into the article and finally allowed to dry. Furniture manufactured from wicker offers greater comfort than furniture manufactured from other materials because of wicker's inherent compliancy. Further, wicker is light weight and reasonably strong, making it an important material in the manufacture of furniture.

In recent years, the popularity of wicker furniture has increased significantly. The casual, informal appearance of wicker has made it especially popular for use in enclosed porches and other informal settings in homes, hotels and other establishments. Natural wicker, however, has had limited use in the outdoor furniture market, including patio furniture, pool furniture and the like. This is because natural wicker softens and weakens when wet, and is more susceptible to rotting and mildew than many other natural and man-made furniture materials. Further, natural wicker furniture is expensive because of the cost of the raw natural wicker which must be harvested and treated. The cost of natural wicker furniture is also increased by the added step of moistening the wicker before weaving it into furniture.

Woven wicker typically comprises a warp yarn, i.e., a yarn running straight through the woven material and providing support, and a weft yarn, i.e., a yarn used as filler that is woven around the warp yarn. Numerous styles of weave are used in the manufacture of wicker furniture. The various styles of weave result in a different look, feel, strength and weight of the finished woven product. In a simple weave pattern, the warp yarns are spaced apart and arranged parallel to each other. The weft yarns are woven over and under alternating warp yarns. Adjacent weft yarns pass on opposite sides of a given warp yarn. Variations of this pattern, such as passing the weft yarn over two adjacent warp yarns, are known in the art.

Wicker is additionally used in the manufacture of furniture by covering structural members such as legs and arms by wrapping. Further, decorative open patterns may be incorporated into an article of furniture between the panels of woven material and the structural members.

A primary reason for the popularity of wicker is its unique, natural look. Inherent imperfections in the natural plant material used in manufacturing wicker furniture create random changes in coloration and texture across the surface of a given woven panel. The imperfections may reflect light differently from the surrounding areas of wicker, or may appear as local changes in color or hue within a woven wicker panel. The small nicks and knots present in a natural wicker yarn further create a unique, mildly rough "feel" to wicker.

Other materials have been used in the manufacture of wicker-like furniture. For example, metallic wire has been wrapped in natural rush or paper and woven to simulate natural wicker furniture. Like natural wicker furniture, furniture made in this manner may not be used in outdoor environments. In addition, the wrapping tends to tear and wear away from the wire, causing unsightly defects.

Polymer yarns have also been used to manufacture wicker-like furniture. In one example of a polymer yarn, a polyester filament cord is coated with a polyvinyl chloride (PVC) coating. Wicker-like furniture manufactured from such polymer yarns has been found to be strong, wear-resistant and relatively inexpensive. In addition, polymer wicker chairs may be used outdoors because the yarn is resistant to the effects of water and the environment. Wicker-like furniture manufactured from a smooth, monochrome polymer yarn, however, has an artificial look and feel. A woven panel of such furniture has a uniform, uninterrupted color and reflects light without variation across its surface. It is immediately evident that furniture manufactured from such yarn has been made from man-made materials, and the furniture has, in general, a "plastic" look. In addition, such panels have a smooth, silky feel, unlike the slightly roughened feel of natural wicker.

In order to overcome these deficiencies in synthetic yarns, a longitudinal color stripe has been added to the outside surface of a polymer yarn in order to give furniture manufactured from that yarn a more natural look. The stripe imparts a variation of color on the surface of a material woven from that yarn. The material, however, remains smooth and silky to the touch, unlike natural wicker and hence, still retained much of its "plastic" look.

In another example in order to impart a more natural feel to a panel woven from a polymer yarn, raised points have been formed on the outside surface of the polymer yarn, giving it a star-shaped cross section. Such raised points interrupt the light reflection by the yarn, decreasing the artificial look of a smooth yarn surface. The raised points, however, form a very rough surface on the woven material, making it uncomfortable and likely to catch delicate clothing.

In sum, no adequate yarn material has been suggested for the manufacture of a wicker-like article of furniture that has the look and texture or feel of natural wicker, but is durable and may be used in a variety of environments such as an outdoor setting.

SUMMARY OF THE INVENTION

In the present invention, a yarn of indeterminate length is provided having a wicker look suitable to be woven into wicker-like articles such as baskets, furniture and the like. In accordance with one embodiment, the yarn has an inner core and an outer coating having an outer surface. At least one groove is formed in the outer surface extending substantially in an axial direction on the yarn. The groove may vary in position around the circumference of the yarn, and may be interrupted in an axial direction along the yarn. The groove may furthermore have a generally rectangular, curved or other cross sectional shape.

The yarn additionally has a visual representation of a stripe of a color or visual appearance other than the color or appearance of the outer surface of the yarn, extending substantially in an axial direction along the yarn. The stripe may vary in position around the circumference of the yarn. Further, the stripe may be located within the groove, or may intersect the groove. The relative circumferential position of the groove and the stripe may vary at different axial positions along the yarn. The stripe may be continuous or interrupted in an axial direction along the yarn.

In another embodiment of the invention, a woven material is provided having a wicker look. The material has a warp comprising a series of spaced warp yarns and a series of weft yarns woven into the warp. The weft yarn has an outer surface of a first color, at least one stripe of a second color, and at least one groove. The stripe and the groove run substantially in an axial direction on the outer surface of the weft yarn. The stripe and the groove are exposed on a surface of the woven material at random, spaced locations. The groove and the stripe may vary in position around the circumference of the weft yarn, and be continuous or interrupted. Further, the warp yarn may have grooves and stripes like those of the weft yarn.

In yet another embodiment, an article of furniture such as a chair is provided having a wicker look. The article is constructed from weave including a yarn having an outer surface of a first color, at least one stripe of a second color and at least one groove. The stripe and the groove run substantially in an axial direction on the outer surface of the yarn, and the stripe and the groove are visible on the chair at random, spaced locations. The stripe and the groove may vary in position around the circumference of the yarn, and be continuous or interrupted.

BRIEF DESCRIPTION OF THE DRAWINGS

The above description, as well as further objects, features and advantages of the present invention will be more fully understood with reference to the following detailed description of a yarn having wicker appearance and articles made therefrom, when taken in conjunction with the accompanying drawings, wherein.

DETAILED DESCRIPTION

Figure 1:
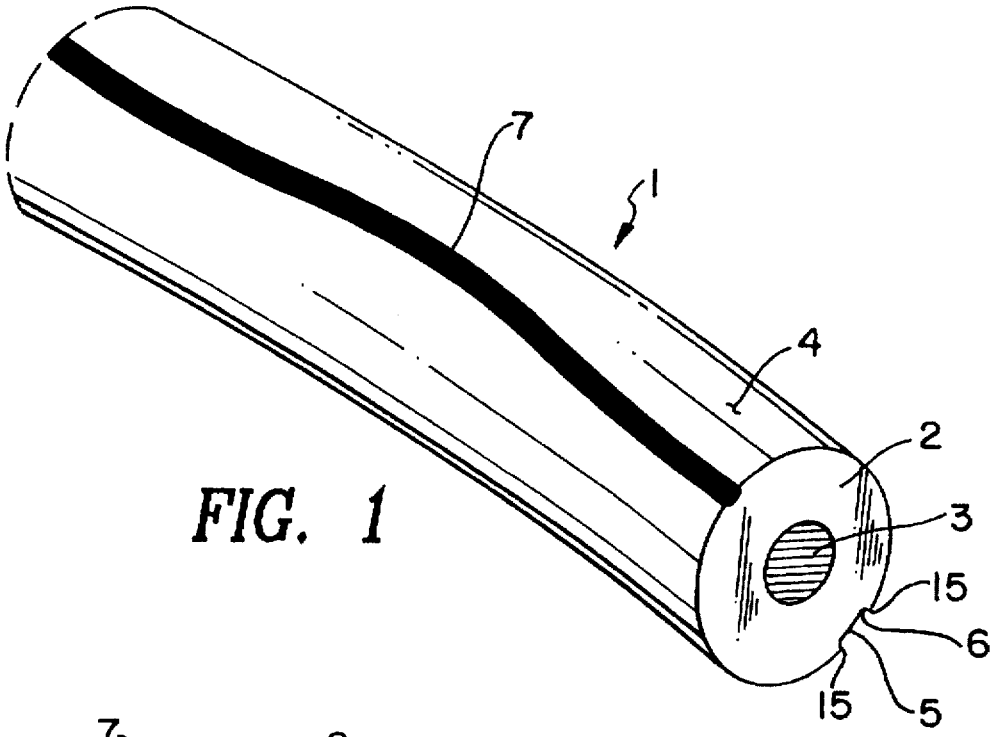
FIG. 1 is a perspective view of a yarn according to one embodiment of the invention having one stripe and one groove.

Referring now to the drawings, there is shown in FIG. 1 a yarn designated generally as reference number 1 constructed in accordance with one embodiment of the present invention. The yarn 1 shown is constructed as an elongated body, such as of indeterminate length, having a core 3 surrounded by a PVC outer coating 2, for example, foamed PVC material which gives greater volume with less material. However, it is to be understood that the outer coating 2 may be formed of other synthetic materials if desired such as polyamides, polyesters and the like. The yarn may be made in a single step using a coextrusion process, as is known in the art. The inner core may include a single filament of polyester, or may include a plurality of polyester filaments bundled to form a single core 3. In addition, the core 3 may be formed of other materials than polyester, monofilament or stranded, such as polyamides and the like. The core 3 is designated to give the yarn 1 greater mechanical strength over yarns formed only of PVC material or the like. However, it is to be understood that the core 3 forms no part of the present invention and may be eliminated if desired.

At least one groove 5 is formed on the outer surface 4 of the yarn. The width of the groove at the outer surface may vary from relatively narrow to much wider, for example, about 45°. The groove may have a shallow depth or deeper from the outer surface 4, and may have a cross section comprising a flat floor with radii 6 or may have a generally rounded cross section (not shown). The groove may be formed by a die during the coextrusion process, or may be formed later using a finishing die.

Figure 2:
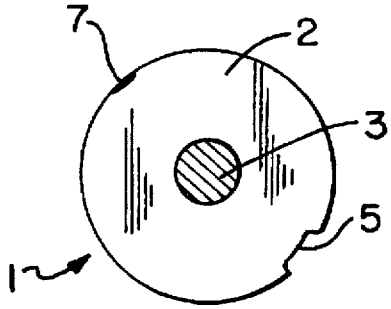
FIG. 2 is a sectional view of the yarn of FIG. 1.

The groove 5 as shown in FIGS. 1 and 2 gives a natural feel to a material woven from the yarn of the invention. The corners 15 formed between the groove 5 and the outer surface 4 of the yarn closely simulates in feel the nicks found in natural wicker materials. Further, the groove itself forms an interruption in the smooth outer surface 4 of the yarn, reflecting light unevenly wherever it is exposed on the surface of material woven from the grooved yarn. The uneven light reflection creates a look closely paralleling the appearance of natural wicker.

Because the groove 5 is a concave feature or inward depression in the outer surface 4 of the yarn, the corners 15 are not so rough as to be uncomfortable to a person seated in a chair made from the yarn, and do not catch clothing. This is a significant advance over designs including convex features such as the star-shaped yarn of the prior art, which may abrade the user and catch clothing.

Figure 6:
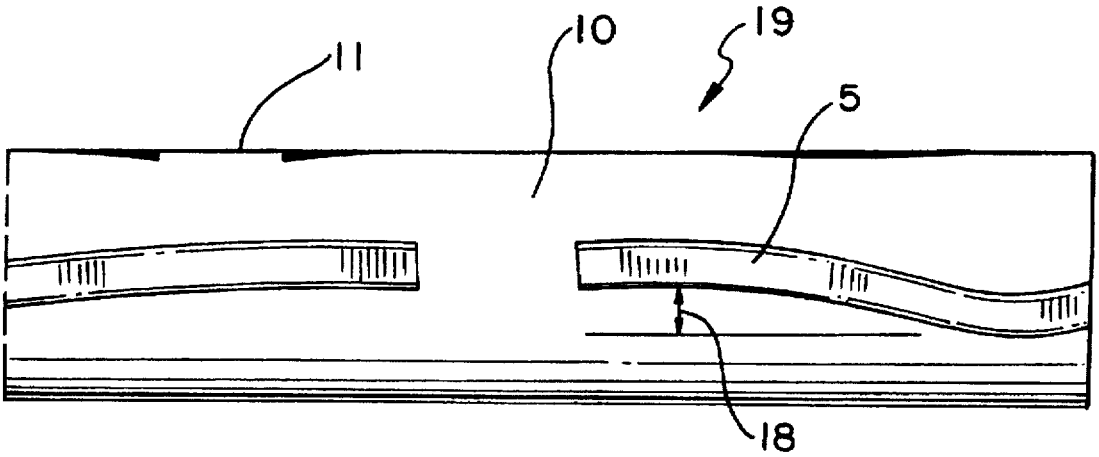
FIG. 6 is an elevation view of the yarn of FIG. 4.

The groove 5 may have a wobble 18, as opposed to being straight as shown in FIG. 21, relative to the axis of the yarn, as shown is FIG. 6, in order to more closely duplicate the conditions on a natural wicker fiber. The wobble causes the groove to vary in position around the circumference of the yarn at various points along the axis of the yarn. The wobble of the groove 5 prevents regular patterns from being formed in a material woven from the grooved yarn, instead presenting a random appearance and disappearance of the groove on the surface of the woven material.

Figure 4:
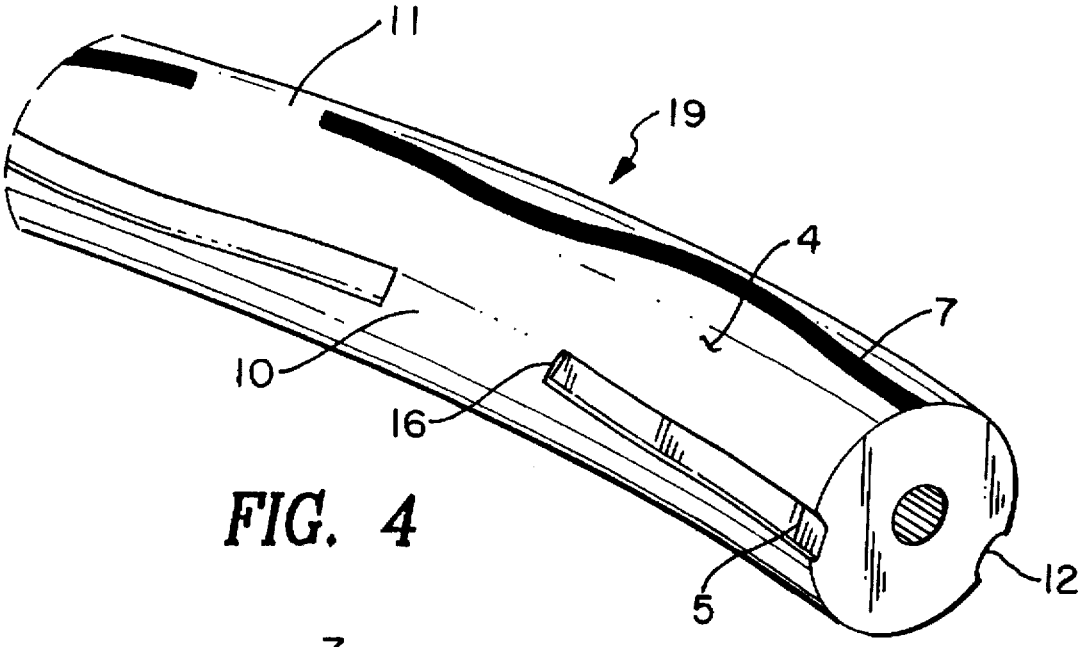
FIG. 4 is a perspective view of a yarn according to another embodiment of the invention having two grooves and one stripe.

In order to further increase the random appearance and disappearance of the groove 5 on the woven material, interruptions 10, shown in FIGS. 4 and 6, may be placed at spaced apart locations along the groove. The interruptions 10 may be of any length and occurrence as desired. In addition to further randomize the light reflected by the woven material, the interruptions 10 form additional corners 16 that present tactile features in an axial direction along the yarn, as compared to the corners 15 that present tactile features in a tangential direction. The corners 16 are detected by a user when running the hand in an axial direction along the yarn, and thus closely simulate the random nicks found on natural wicker materials.

In an alternative form of groove interruption (not shown), a smooth transition is made between the groove 5 and the outer surface 4. This embodiment provides a less prominent tactile feature in the axial direction of the yarn. Accordingly, it can be appreciated that the groove 5 can be constructed in a variety of forms which may be randomly oriented and arranged on the outer surface 4.

Figure 3:
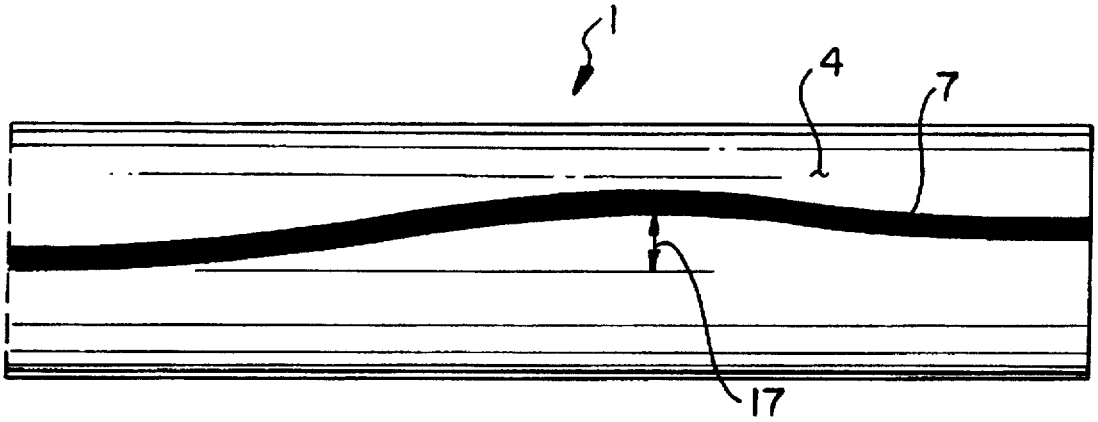
FIG. 3 is an elevation view of the yarn of FIG. 1.

In addition to the grooves 5, at least one stripe 7 is placed on the outer surface 4 of the yarn 1 in order to further enhance the natural look of material woven from the yarn 1, as shown in FIGS. 1–3. The stripe 7 is of a different color or different hue than that of the outer surface 4. In this regard, the stripe 7 provides a visual representation or visual appearance of an area being distinguished from the remaining surface of the yarn 4. For example, on a natural or tan-colored wicker yarn, a black or brown stripe may be used. In another example, a yellow stripe may be used on a green yarn or a gray stripe on a white yarn. As the yarn is woven into a material, the stripe appears at random locations on the surface of the material, interrupting the otherwise uniform color of the surface. These random interruptions simulate the color variations and imperfections of natural wicker fiber, making the woven material closely resemble wicker.

The stripe 7 may have a wobble 17, as opposed to being straight, with respect to the axis of the yarn, as shown in FIG. 3. The wobble further randomizes the appearance of the stripe on the surface of the woven material. In one example of the yarn, the magnitude of wobble of the stripe 7 is approximately equal to that of the grooves.

Figure 5:
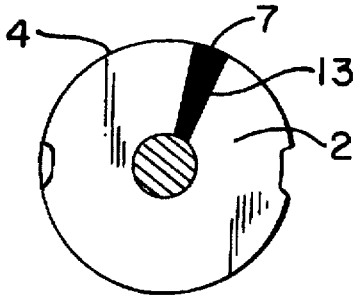
FIG. 5 is a sectional view of the yarn of FIG. 4.

The stripe 7 may be molded into the yarn during the coextrusion process with the core 3 when present, and may extend deep into the yarn as a color portion 13 of the outer coating 2, shown in FIG. 5. Such a configuration is advantageous over painting or inking the stripe 7 on the yarn which may also be used, in that the color portion 13 may not be removed by wear on the outer surface 4. The stripe 7 may incorporate interruptions 11, as shown in FIGS. 4 and 6. The interruptions may be of any length and occurrence as desired. The interruptions 11 simulate the interrupted nicks and scratches appearing on natural wicker fibers.

Additional stripes and/or grooves may be incorporated in the yarn in order to further enhance the natural appearance of a fabric woven from the yarn. In the example shown in FIGS. 4–6, two grooves 5 and 12, located by way of one example approximately 180 degrees apart, are formed on the yarn 19 in conjunction with stripe 7. The use of two grooves increases the frequency that the groove appears on a given surface of the woven material, making the woven material feel and appear rougher.

Figure 7:
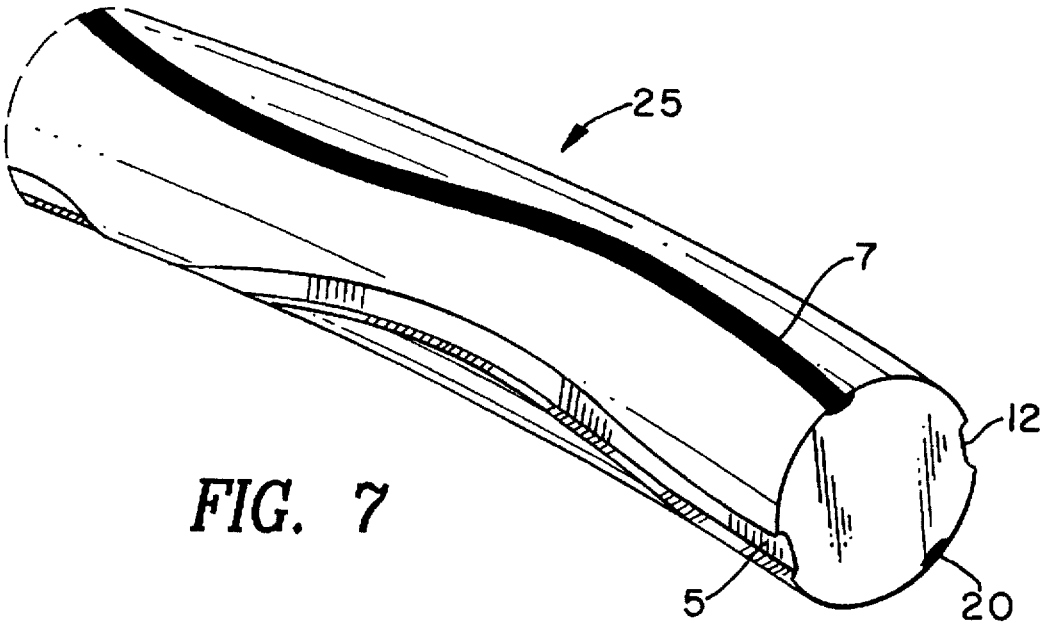
FIG. 7 is a perspective view of a yarn according to another embodiment of the invention having two grooves and two stripes.
Figure 8:
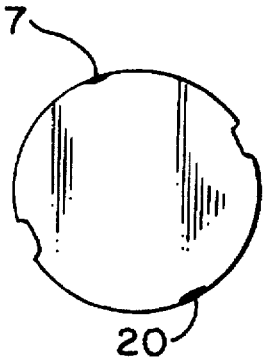
FIG. 8 is a sectional view of the yarn of FIG. 7.
Figure 9:
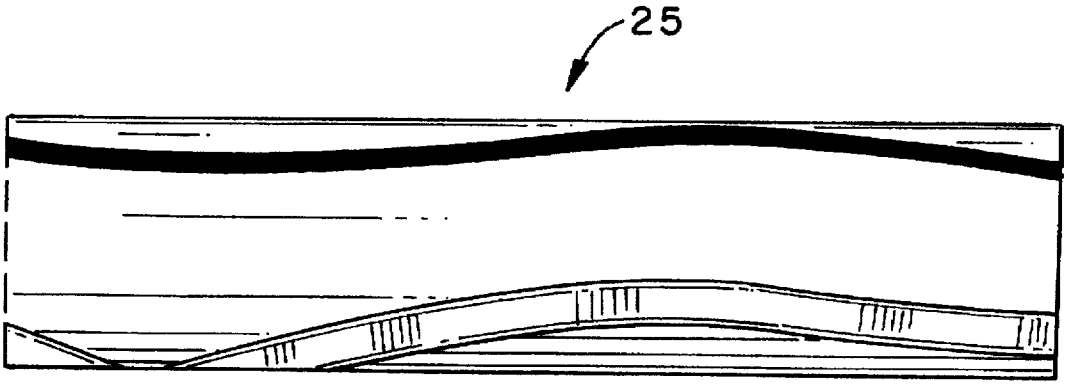
FIG. 9 is an elevation view of the yarn of FIG. 7.
Figure 10:
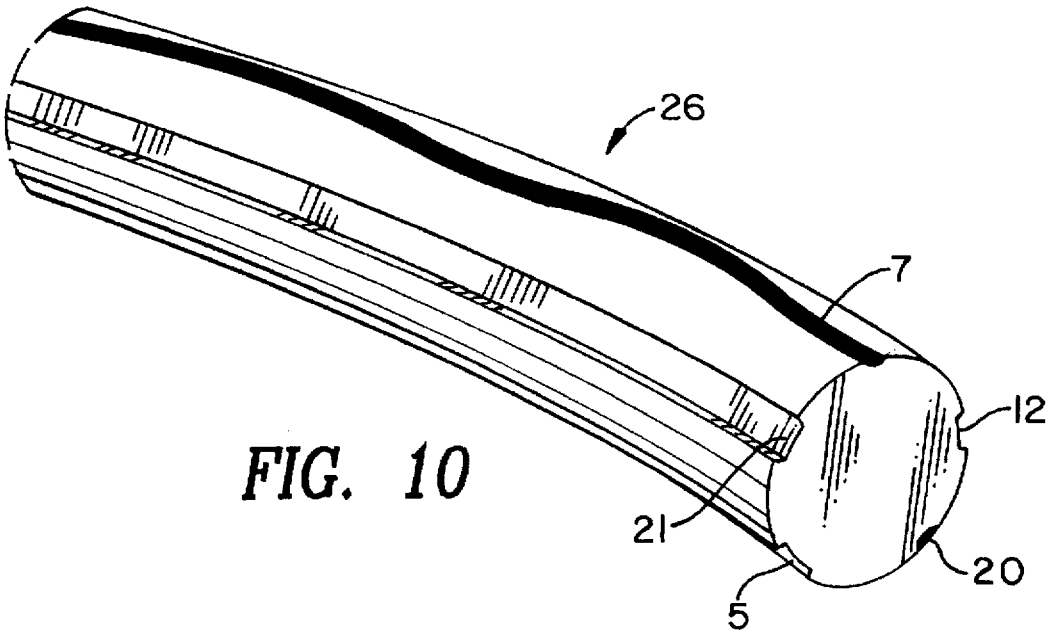
FIG. 10 is a perspective view of the yarn according to another embodiment of the invention having three grooves and two stripes.
Figure 11:
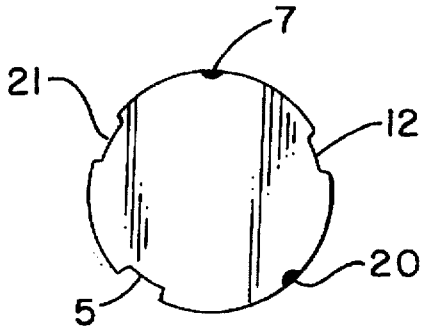
FIG. 11 is a sectional view of the yarn of FIG. 10.
Figure 12:
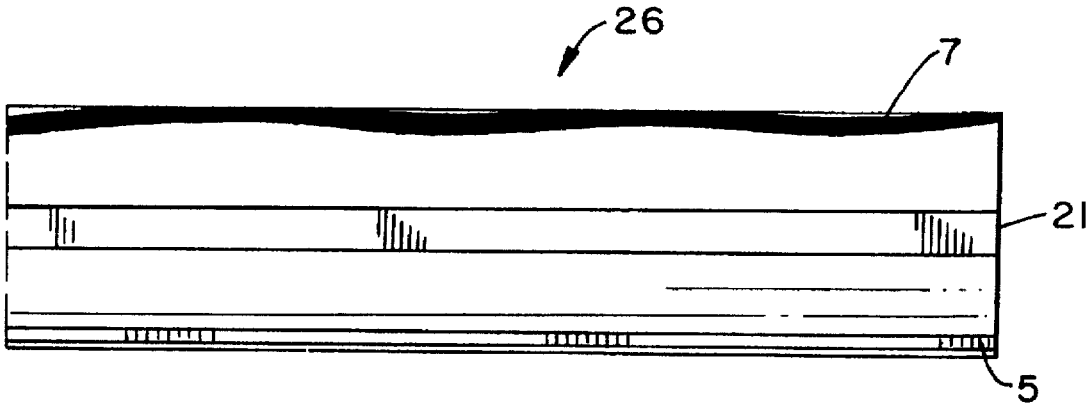
FIG. 12 is an elevation view of the yarn of FIG. 10.

Additional stripes may be placed on the yarn, as shown in FIGS. 7–9. Stripes 7 and 20 are placed on the wicker yarn 25 by way of one example approximately 180 degrees apart. The use of two stripes increases the frequency that a stripe appears on a given surface of the woven material, giving the woven material the appearance of having a larger number of darker or differently colored areas. Additional stripes and/or grooves may be added in order to achieve the desired effect on the finished material. For example, in FIGS. 10–12, three grooves 5, 12, 21, and two stripes 7, 20, are placed around the circumference of the wicker yarn. The stripes 7, 20 wobble with respect to the axis of the wicker yarn as previously described. The grooves 5, 12, 21 as shown do not wobble. The configuration shown in FIGS. 10–12, when woven into a wicker-like material, provides surfaces that are very rough in both look and feel, with a medium amount of random interruption in the color of the material. Other combinations of stripes and grooves on a wicker-like yarn may be utilized in order to achieve varying amounts of roughness and color interruption. The invention is therefore not limited to the examples provided herein, which are only exemplary of the present invention.

Figure 13:
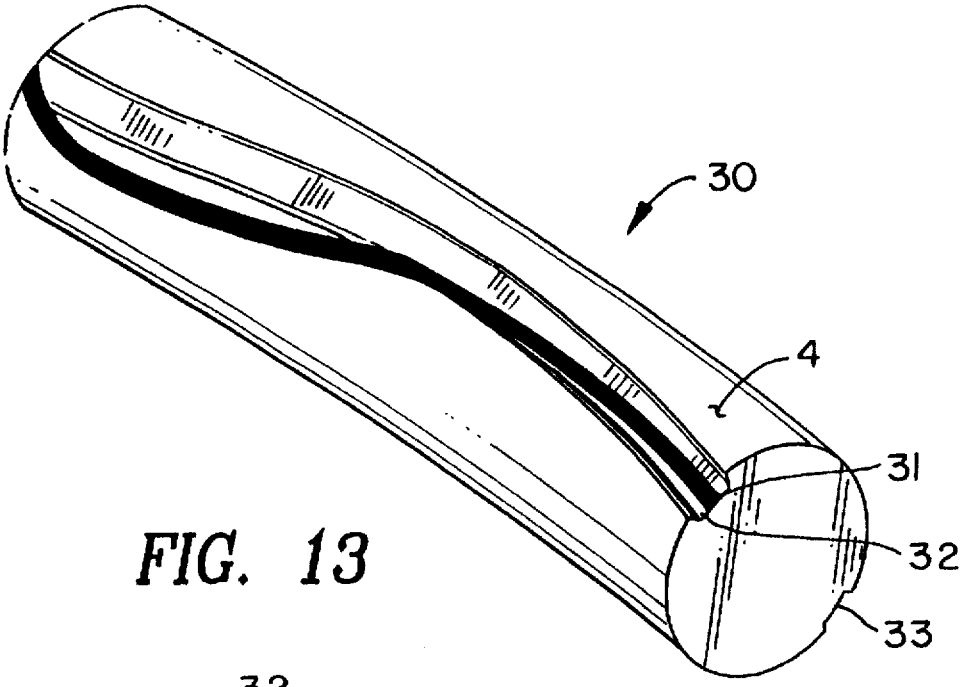
FIG. 13 is a perspective view of a yarn according to another embodiment of the invention having a stripe intersecting a groove.
Figure 14:
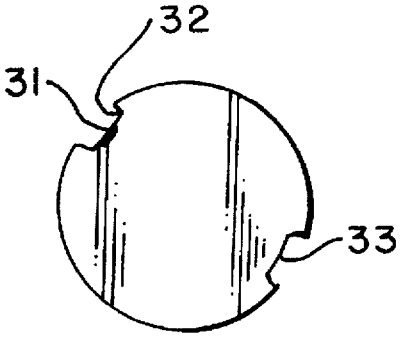
FIG. 14 is a sectional view of the yarn of FIG. 13.
Figure 15:
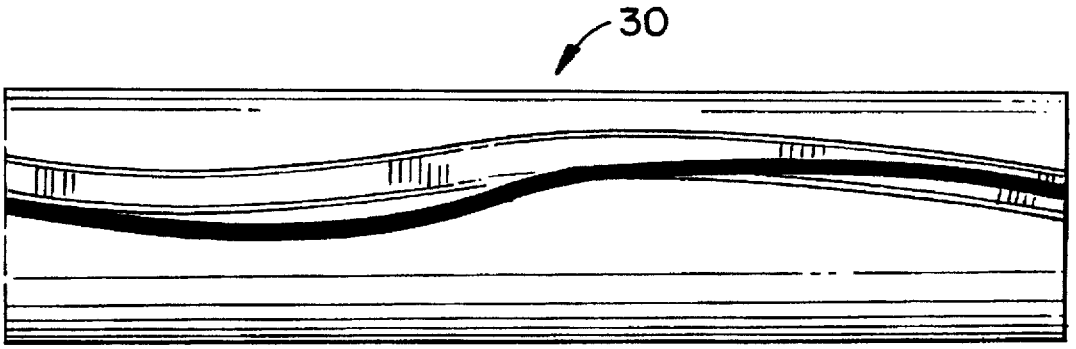
FIG. 15 is an elevation view of the yarn of FIG. 13.

A stripe and a groove provided on a single wicker yarn may remain separated as shown in FIGS. 1–2, or may intersect as shown in FIGS. 13–15. Stripe 31, shown in FIGS. 13–15, is superimposed on the groove 32 at various locations along the axis of the yarn 30. The appearance of a material woven from the yarn 30 is further altered by the changing surface upon which the stripe 31 appears. As the stripe 31 makes a transition from the outer surface 4 of the yarn 30 to the groove 32, the appearance of the stripe changes, giving a different look to the woven material. The use of a stripe intersecting a groove may be combined with the use of multiple grooves, such as grooves 32, 33, shown in FIGS. 13–15, and may also be used in combination with various numbers of grooves and stripes, in order to produce a desired effect on a woven material.

Figure 16:
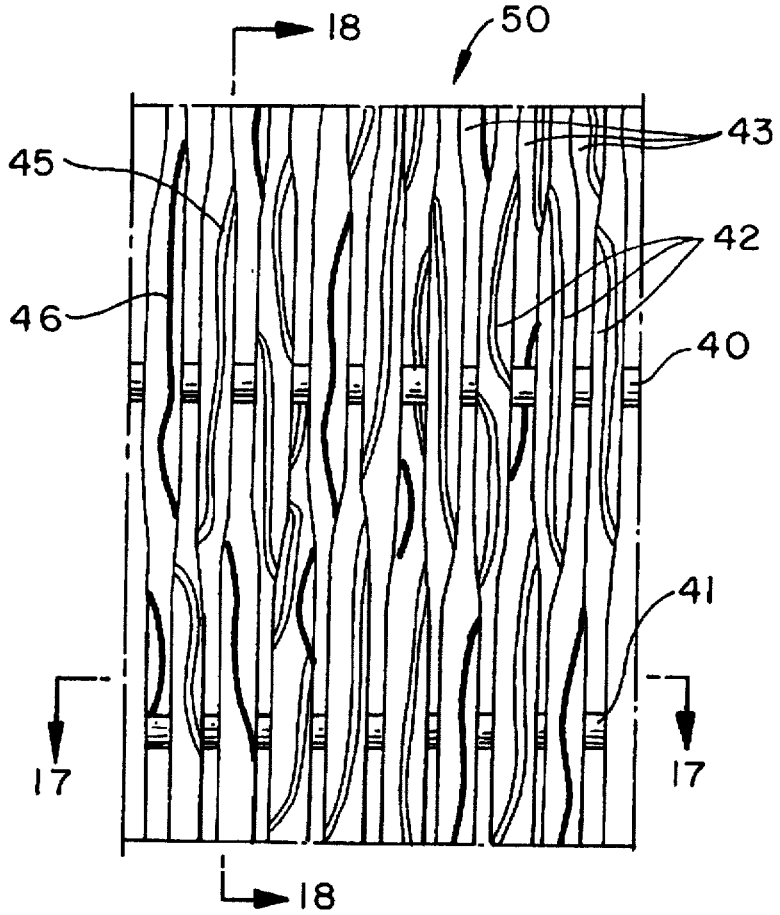
FIG. 16 is a plan view of a material according to the invention woven from polymer yarns having grooves and stripes.
Figure 17:
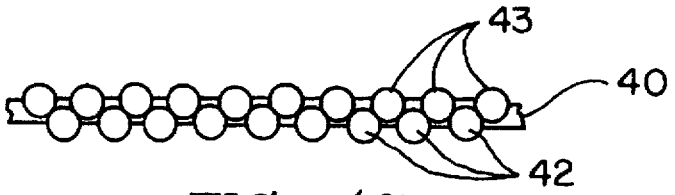
FIG. 17 is a sectional view of the material of FIG. 16 at line 17—17.
Figure 18:
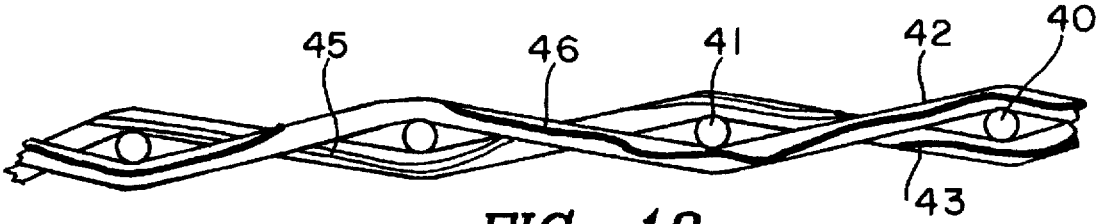
FIG. 18 is a sectional view of the material of FIG. 16 at line 18—18.

A woven material 50 of the invention comprises warp yarns, such as yarns 40, 41 and weft yarns, such as yarns 42, 43, as shown in the example of FIGS. 16–18. The weave pattern shown in these figures is by way of example, and those skilled in the art will recognize that other weave patterns may be utilized to meet various requirements of strength, look, feel, texture, design, and weight. Warp yarns 40, 41 are placed at even, spaced apart intervals and traverse the material in a substantially straight path. Weft yarns, or "filler" yarns 42, 43 are woven on alternating sides of the warp yarns 40, 41. For example, weft yarns 42 pass on top of the warp yarn 40, while weft yarns 43 pass beneath the warp yarn 40, as shown in FIG. 16. Weft yarns 42 then proceed beneath the warp yarn 41, while weft yarns 43 proceed on top of the warp yarn 41. This weaving pattern is continued throughout a given panel of material. As can be seen in the plan view of FIG. 16, grooves 45 and stripes 46 on the weft yarns 42, 43 impart a random "natural" wicker look to the woven material. In the example shown in FIGS. 16–18, each weft yarn has a single groove and a single stripe, both of which wobble with respect to the yarn axis. Additional grooves and/or stripes may be added in order to increase the effects each of those elements has on the overall look of the material 50.

It is to be understood that it is not required that the warp yarns 40, 41 include stripes and grooves of the present invention. In this regard, the warp yarns 40, 41 can be convention yarns as they are generally concealed by the weft yarns 42, 43. Similarly, it is not required that all of the weft yarns 42,43 be constructed in accordance with the present invention. Other conventional yarns can be combined with the weft yarns 42, 43 to give the weave 50 a particular look which still retains a wicker look and feel without departing from the present invention.

The wicker-like yarns to be woven into material, such as material 50, may if desired be heated before the weaving process, or may be woven immediately after the coextrusion process before the yarns cool. By weaving the yarns in a heated state, adjacent weft yarns 42, 43 adhere to each other and adhere to the warp yarns 40, 41. In this way, a more stable woven material 50 is produced. Alternatively, an adhesive may be used between the yarns in order to produce similar results if desired.

Figure 19:
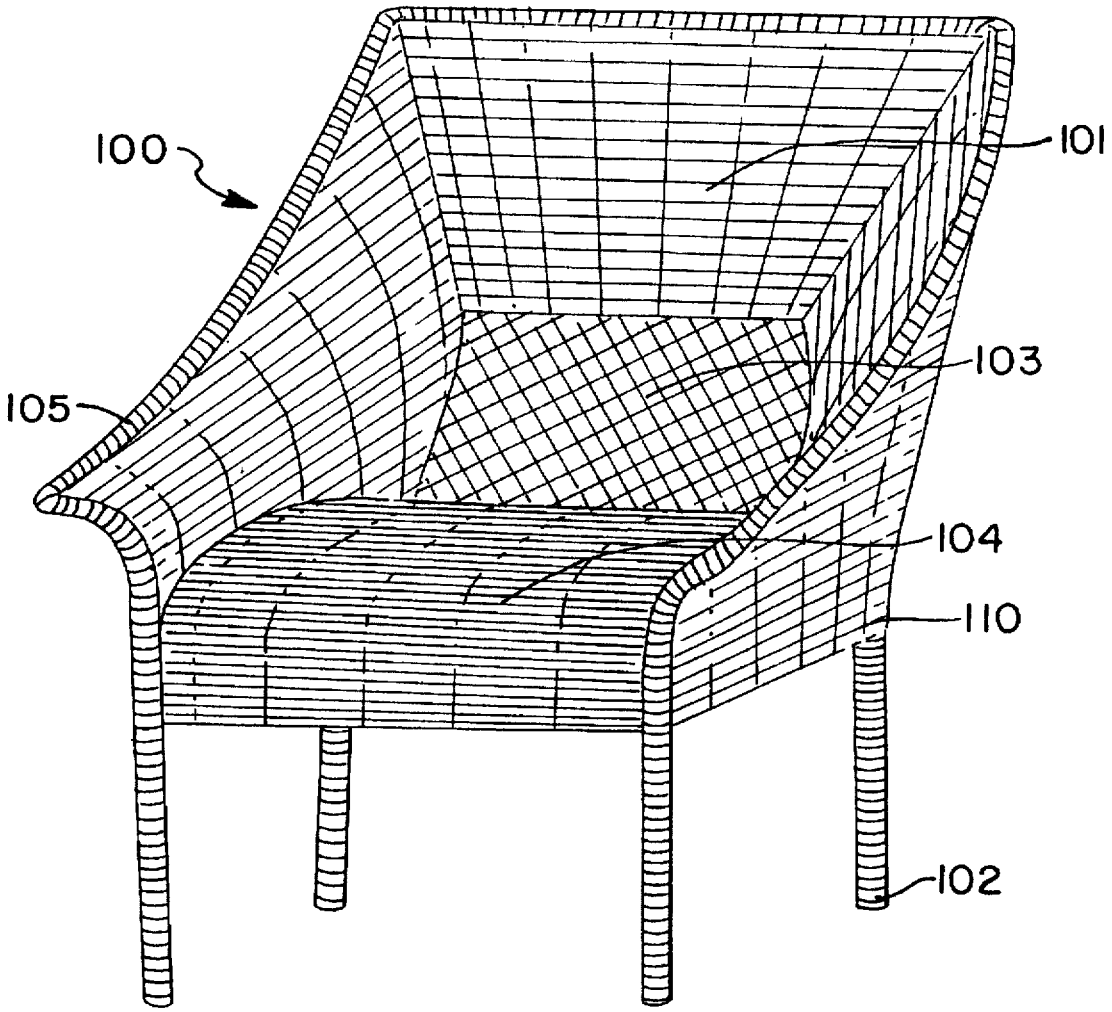
FIG. 19 is perspective view of an article of furniture according to the invention.

A furniture item of the invention, such as the wicker-like chair 100 shown in FIG. 19, may be produced from a rigid skeletal frame 110 covered by weaving yarns of the invention into woven material panels such as panel 101 forming the back of the chair 100, and panel 104 forming the seat of the chair which are attached to the frame. The chair has a look and feel of natural wicker because of the use of stripes and grooves on the yarn used in making the panels. Yarns with stripes and/or grooves may also be used in wrapping the structural members of the frame such as legs 102 and arms 103, giving those members a natural wicker look as well. Such yarns may also be used in forming lattice work such as the lower chair back 103, which is often formed using the warp yarns of adjacent woven panels. Other furniture items such as couches, tables, benches, stools, trunks, and the like can also be produced using the yarn disclosed in accordance with the present invention so as to have a wicker look.

Chair 100 may be fabricated from wicker yarns of the invention having colors other than the color of natural wicker. Such chairs have the advantages of color coordination offered by a painted wicker chair, while maintaining the random coloration and the slightly rough feel of natural wicker.

It is understood that the above-described embodiments are merely illustrative, and that many variations can be devised by those of skill in the art without departing from the scope of the invention. For example, although the yarn has been shown as cylindrical in shape, other shapes such as square, oval, triangular and the like can be used.

I claim:

1. An article of furniture having a wicker look comprising a frame having a shape of an article of furniture and at least one panel woven from a yarn comprising an elongated body of polymer material having an outer surface, at least one groove depressed in said outer surface extending substantially in an axial direction along said body, and at least one visual representation of a stripe on said outer surface extending in substantially an axial direction along said body, said groove and said stripe being visible on said panel.

2. The article as claimed in claim 1, wherein said stripe and said groove vary in position around a circumference of said yarn.

3. The article as claimed in claim 1, wherein said frame comprises a structural member wrapped with said yarn.

4. The article of claim 1, wherein said frame is in the shape of a chair.

5. The article of claim 4, wherein said panel forms a seat and back of said chair.

6. The article as claimed in claim 1, wherein said yarn is foamed material.

7. The article as claimed in claim 6, wherein said yarn further includes a polymer filament core surrounded by said foamed material.

8. The article as claimed in claim 1, wherein said groove varies in radial position around said yarn.

9. The article as claimed in claim 1, wherein said stripe intersects said groove.

10. The article as claimed in claim 1, wherein said stripe varies in radial position around said yarn.

11. The article as claimed in claim 1, wherein said groove includes a wobble.

12. The article as claimed in claim 1, wherein said stripe includes a wobble.

13. The article as claimed in claim 1, further including a plurality of grooves.

14. The article as claimed in claim 1, further including a plurality of stripes.

15. An article of furniture having a wicker look comprising a frame having a shape of an article of furniture and at least one panel woven from a yarn comprising an elongated body of polymer material having an outer surface of a first color, said yarn having at least one stripe of a second color and at least one groove depressed in the outer surface of said yarn, said stripe and said groove running substantially in an axial direction on said outer surface of said yarn, said groove and said stripe being visible on said panel.

16. The article of claim 15, wherein said frame is in the shape of a chair.

17. The article of claim 15, wherein said panel forms a seat and back of said chair.

18. The article as claimed in claim 15, wherein said yarn is foamed material.

19. The article as claimed in claim 18, wherein said yarn further includes a polymer filament core surrounded by said foamed material.

20. The article as claimed in claim 15, wherein said groove varies in radial position around said yarn.

21. The article as claimed in claim 15, wherein said stripe intersects said groove.

22. The article as claimed in claim 15, wherein said stripe varies in radial position around said yarn.

23. The article as claimed in claim 15, wherein said groove includes a wobble.

24. The article as claimed in claim 15, wherein said stripe includes a wobble.

25. The article as claimed in claim 15, further including a plurality of grooves.

26. The article as claimed in claim 15, further including a plurality of stripes.

* * * * *